United States Patent [19]

Holzer

[11] 4,453,677

[45] Jun. 12, 1984

[54] DEVICE FOR DOFFING A BOBBIN

[75] Inventor: Alois Holzer, Wehringen, Fed. Rep. of Germany

[73] Assignee: Hoechst Aktiengesellschaft, Fed. Rep. of Germany

[21] Appl. No.: 507,758

[22] Filed: Jun. 27, 1983

Related U.S. Application Data

[62] Division of Ser. No. 270,346, Jun. 4, 1981.

[30] Foreign Application Priority Data

Jun. 12, 1980 [DE] Fed. Rep. of Germany ..... 3022041

[51] Int. Cl.[3] ..... B65H 54/44

[52] U.S. Cl. ..... 242/18 R; 242/18 A; 242/18 DD; 242/46.4

[58] Field of Search ..... 242/18 DD, 18 R, 18 A, 242/46.4, 65, 66, 36, 37, 39

[56] References Cited

U.S. PATENT DOCUMENTS

| | | | |
|---|---|---|---|
| 2,622,810 | 12/1952 | Stream et al. | 242/18 A |
| 2,663,507 | 12/1953 | Soussloff | 242/18 A |
| 3,495,781 | 2/1970 | Graf et al. | 242/46.4 |
| 3,498,551 | 3/1970 | Briner et al. | 242/46.4 X |
| 3,722,807 | 3/1973 | Swinehart | 242/46.4 X |
| 3,779,472 | 12/1973 | Boggs | 242/18 DD |
| 3,823,885 | 7/1974 | De Schulthess | 242/18 A |
| 3,841,574 | 10/1974 | Lenk et al. | 242/18 A X |
| 4,007,884 | 2/1977 | Schippers et al. | 242/18 A X |
| 4,036,446 | 7/1977 | Schar | 242/46.4 X |
| 4,103,833 | 8/1978 | Hasegawa et al. | 242/18 A |

*Primary Examiner*—Stanley N. Gilreath
*Attorney, Agent, or Firm*—Connolly and Hutz

[57] ABSTRACT

The invention relates to a device for doffing a bobbin clamped to a bobbin holder mounted on a pivot lever fitted to a winding housing. The bobbin is held by expanding clamping tongs which are tensioned, and opened, by means of a spring via a ram which is connected via a driver pin to a slider/thrust member system which, in conjunction with a brake disc and brake shoe arrangement, effects braking of the bobbin, when it is pivoted from the winding position into the doffing position. This purely mechanical method is simpler and less costly than conventional doffing methods with the inherent risk of accidents, faults and waste.

1 Claim, 3 Drawing Figures

DEVICE FOR DOFFING A BOBBIN

This application is a division of application Ser. No. 270,346 filed June 4, 1981 .

The invention relates to a device for doffing a bobbin clamped on a bobbin holder which is rotatably mounted on a pivot lever which in turn is fitted to the housing of a winding frame.

A winding frame with automatic bobbin change and automatic yarn change-over has been disclosed by German Utility Model No. 7,605,262 .

This frame has two bobbins which are arranged axially side by side and onto which the yarn is wound alternately in succession. Each bobbin is seated on a bobbin holder which is rotatably mounted on a pivot lever. With the pivot lever swung out, the empty bobbin is pushed over the bobbin holder and fixed to the end of the bobbin holder by means of a tightening screw. During a bobbin change which is initiated manually or by a control system, this empty bobbin pivots into the winding position, by means of its pivot lever, filament is strung up or laced up and the full bobbin pivots out.

Due to its inertia, this full bobbin continues to rotate; it is braked by the operator, the tightening screw on the bobbin holder is released, the full bobbin is doffed and an empty bobbin is put on.

This bobbin change is very labour-intensive and can lead to faults.

It is therefore the object of the present invention to provide a doffing device for the full bobbin, which device replaces the involved attaching or fastening of the bobbin to the bobbin holder with the aid of a tightening screw and dispenses with manual braking of the bobbin.

According to the invention, these objects are achieved by a relatively simple and highly reliable device.

Figure 1:
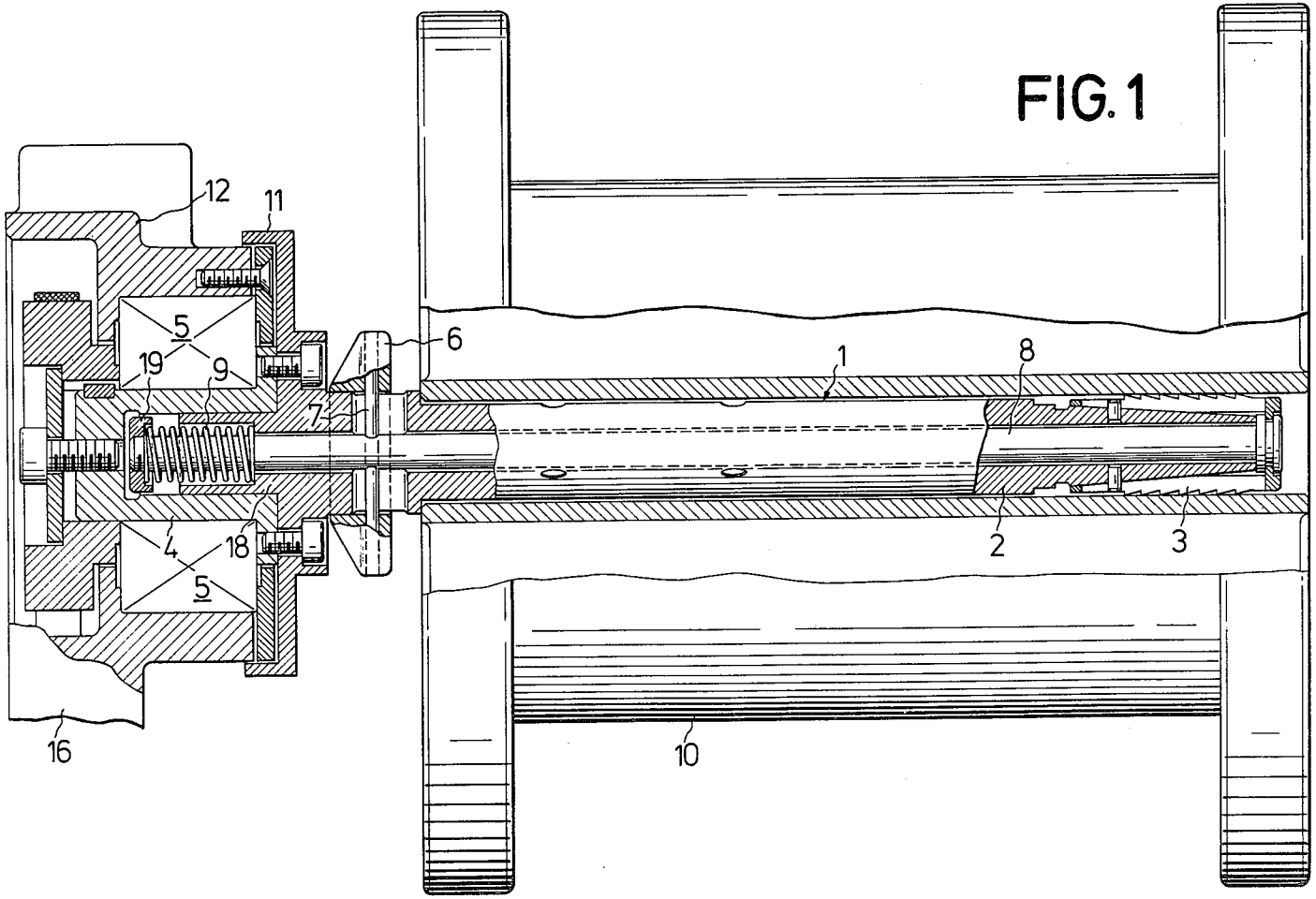
Figure 1A:
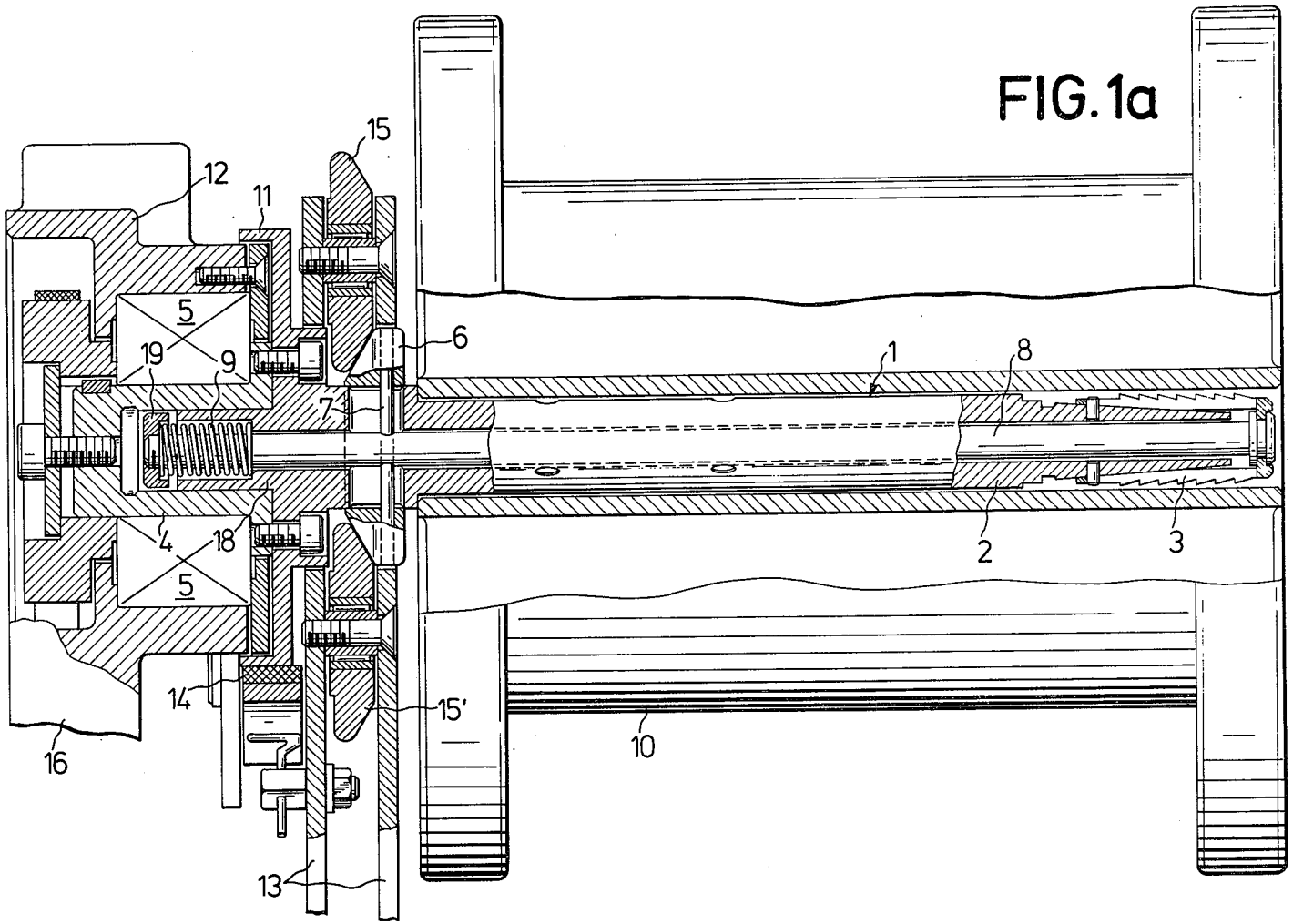
Figure 2:
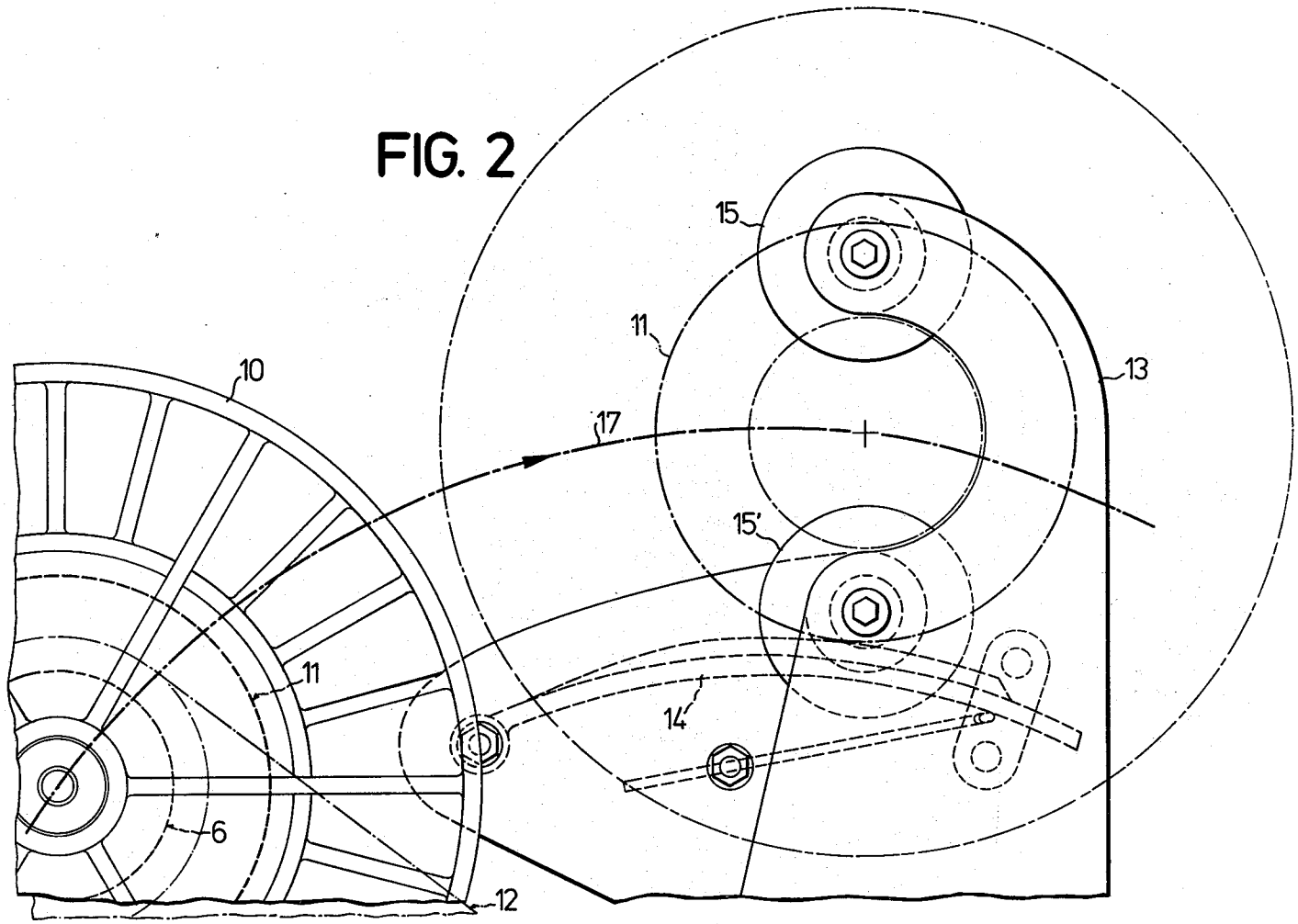

Novel features and advantages of the present invention in addition to those mentioned above will become apparent to those skilled in the art from a reading of the following detailed description in conjunction with the accompanying drawing wherein:

FIG. 1 is a longitudinal sectional view through a bobbin and a winding frame with the bobbin holder in its clamped state;

FIG. 1*a* is a longitudinal sectional view through a bobbin and a winding frame taken along lines 1—1 of FIG. 2 with the bobbin holder in its unclamped or released state; and FIG. 2 is a side view of the winding frame illustrating the two positions of the bobbin, namely in the pivoted-in state (left-hand half) during the winding process and in the pivoted-out state during the bobbin change (right-hand half).

In a device according to the present invention, the bobbin 10 is held by expanding clamping tongs 3 which are tensioned via a ram 8 by a spring 9; this ram 8 is connected via the driver pin 7 to a conical slider 6; when the bobbin holder 1 is pivoted from the winding position into the doffing position, the bobbin is braked and the conical slider 6 comes into engagement with a conical thrust member 15 fixed to the housing 16; the conical slider 6 and hence also the ram 8 are thus axially moved in such a way that the clamping tongs 3 are opened.

Preferably, a brake disc 11 is fixed to the bobbin holder 1 on its side facing the pivot lever 12, which brake disc is rotationally symmetrical to the axis of the bobbin holder 1 and comes into engagement with a brake shoe 14 fixed to the housing 16 of the winding frame, when the bobbin holder 1 is pivoted from the winding position into the doffing position, and thus brakes the rotating bobbin holder 1 to a stop. In the figures, the numerals having the following meanings: 1 is a bobbin holder, 2 is a spindle, 3 are clamping tongs, 4 is a seating bushing, 5 is a bearing, 6 is a slider, 7 is a driver pin, 8 is a ram, 9 is a spring, 10 is a bobbin, 11 is a brake disc, 12 is a pivot lever, 13 is a roller support, 14 is a brake shoe, 15 is a thrust member, 15' is a thrust member, 16 is a housing, 17 is the path of the bobbin holder axis, 18 is the inner end of the spindle 2 and 19 is a seat for the spring 9.

The complete bobbin holder 1 comprises a spindle 2 and clamping tongs 3 as well as a seating bushing 4 which is rotatable mounted in the bearing 5 of the pivot lever 12. The seating bushing 4 carries a conical slider 6 which is connected via a driver pin 7 to a ram 8. The ram 8 is held by a spring 9 in such a way that the clamping tongs 3 are tensioned, that is to say the bobbin 10 is retained on the bobbin holder 1. The spindle 2 also carries a brake disc 11.

In FIG. 2 it can be seen how, when the pivot lever 12 is pivoted out after the end of the winding process, the rotating bobbin 10 moves into the zone of the roller support 13. In this zone, the brake shoe 14 is arranged in such a way that the brake disc 11 exerts an increasing pressure on the brake shoe 14 and thus brakes the rotating bobbin holder 1, together with the bobbin 10, to a stop. As is well known the bobbin holder may be rotated by an electro motor or by appropriate rotating friction rollers that engage the bobbin holder or the bobbin itself. The conical slider 6 of the stopped bobbin then comes into contact with the two conical thrust members 15 and 15'. During this, the centre of the bobbin holder runs along the path 17 (FIG. 2).

These thrust members 15 and 15' force the conical slider 6 to the right, that is to say in the direction of the free end of the bobbin holder 1, and the driver pin 7 transfers this motion to the ram 8 which, as a result, opens the clamping tongs 3.

The stopped full bobbin which is no longer retained on the bobbin holder can now be doffed to the right towards the free end.

An empty bobbin can now again be placed onto the bobbin holder. For a bobbin change, that is to say when the other bobbin, in our example therefore the right-hand bobbin, is fully wound, the left-hand bobbin holder 1 is pivoted in with the aid of the pivot lever 12, the slider 6 is moved away from the thrust members 15 and 15' and the clamping tongs 3 are thus expanded again and retain the bobbin 10.

The brake shoe can be, for example, a brake disc with a wearing layer, or it can be the coil of an eddy-current brake.

As soon as the bobbin - which is on the left in the example has been pivoted in, the change-over step described in German Utility Model No. 7,605,262 can be carried out, the fully wound bobbin on the right is pivoted out and the bobbin change process described above now starts for this bobbin. The corresponding parts of the equipment are here arranged in mirror symmetry.

The point in time of the bobbin change can be triggered manually or by control mechanisms known per se. The doffing of the full bobbins and the insertion of empty bobbins is carried out manually or by means of suitable automatic doffer units. The entire winding time of the other bobbin is available for these two steps.

The advantage of the purely mechanical solution according to the invention is its simplicity which is reflected in low manufacturing costs and maintenance costs. Moreover, a mechanical solution requires less space than hydraulically or pneumatically actuated clamping tongs for the bobbin.

The fixing of the bobbin by means of a tightening screw is time-consuming. Moreover there is a risk of the tightening screw not being tightened, or not being sufficiently tightened, so that the bobbin is not properly driven and waste is thus produced.

The device according to the invention guarantees firm seating of the bobbin, whereas fixing with a screw, according to the state of the art, frequently proves to be inadequate.

The device according to the invention prevents the filament ends of the full bobbins from catching on neighboring bobbins and thus leading to faults and waste.

The doffing device also eliminates the acute accident risk which exists when the full bobbin is braked by hand.

It is also possible to arrange several bobbins on one bobbin holder; in this case, of course, the clamping tongs must be appropriately adapted.

I claim:

1. A device for doffing bobbins on a winding mechanism having a housing with a bobbin holder pivotally connected thereto consisting of a spindle with clamping tongs thereon constructed and arranged for movement between bobbin clamping and release positions, a rotatable bushing at one end of the spindle, a slidable ram extending through the bushing and spindle connected at one end to the clamping tongs, biasing means connected between the bushing and the other end of the ram urging the ram and the clamping tongs to the bobbin clamping position, a conical slider slidable on the bushing and connected to the ram, a brake disc connected to rotate with the bushing, means for pivoting the bobbin holder between winding and doffing positions, and a thrust member connected to the housing arranged to engage and shift the conical slider at the doffing position of the bobbin holder whereby the ram connected to the slider shifts against the force of the biasing means to thereby move the clamping tongs to the bobbin release position, the thrust members including a brake shoe connected thereto that engages the brake disc at the doffing position to stop the rotation of the spindle.

* * * * *